US010887954B1

(12) United States Patent
Lan et al.

(10) Patent No.: US 10,887,954 B1
(45) Date of Patent: Jan. 5, 2021

(54) RESISTANCE CONTROL DEVICE AND ITS LAMP

(71) Applicant: SHENZHEN GUANKE TECHNOLOGIES CO., LTD, Shenzhen (CN)

(72) Inventors: Qing Lan, Shenzhen (CN); Xuren Qiu, Shenzhen (CN); Ligen Liu, Shenzhen (CN); Shoubao Chen, Shenzhen (CN); Wenhao Lin, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 16/732,571

(22) Filed: Jan. 2, 2020

(30) Foreign Application Priority Data

Oct. 24, 2019 (CN) ..... 2019 1 1021897

(51) Int. Cl.

| | |
|---|---|
| ***F21V 21/30*** | (2006.01) |
| ***F21V 29/76*** | (2015.01) |
| ***F21V 17/02*** | (2006.01) |
| ***H05B 41/39*** | (2006.01) |
| ***F21V 23/02*** | (2006.01) |

(52) U.S. Cl.
CPC ..... *H05B 41/39* (2013.01); *F21V 23/02* (2013.01)

(58) Field of Classification Search
CPC ..... H05B 41/39; F21V 23/02; F21V 21/30; F21V 29/763; F21V 14/02; F21Y 2105/12; F21Y 2115/10; F21Y 2105/10; F21K 9/23
See application file for complete search history.

(56) References Cited

U.S. PATENT DOCUMENTS 6,689,050 B1 * 2/2004 Beutter ..... A61B 1/00059 600/117
2010/0327725 A1 * 12/2010 Huang ..... F21V 29/767 313/46
2020/0240621 A1 * 7/2020 Lan ..... F21V 29/763

* cited by examiner

*Primary Examiner* — Minh D A
(74) *Attorney, Agent, or Firm* — Maier & Maier, PLLC

(57) ABSTRACT

A resistance control device and its lamp. The resistance control device includes: a shell, which is provided with an accommodating chamber and the first opening and the second opening connecting the accommodating chamber; and a control module, which includes the resistor and the external plug in the accommodating chamber. The external plug is electrically connected to the resistor. One end of the external plug is set extending the first opening. The external plug is used to connect the resistor to the lamp; and a boosting part, which is connected to the resistor and exposed in the second opening. The boosting part is used to twist or toggle the resistor to adjust the resistance value of the resistor accessing to the lamp. The resistance control device can be removed to achieve the quick separation and assembly of the lamp and improve the use convenience.

10 Claims, 4 Drawing Sheets

RESISTANCE CONTROL DEVICE AND ITS LAMP

CROSS-REFERENCE TO RELATED APPLICATIONS

This application claims the priority of Chinese Patent Application No. 201911021897.5 filed on Oct. 24, 2019, the disclosure of which is incorporated herein by reference.

FIELD

The present invention relates to the field of lighting equipment, in particular to a resistance control device and a lamp applying the resistance control device.

BACKGROUND

In the use of lamps, it is necessary to adjust the power of lamps and to adjust the luminous intensity of lamps. Commonly, the pulse-width modulated signal can be connected at the back end of the driving power supply to adjust the output current of the driving power supply; or 0-10V voltage signal can be accessed to the back end of the driving power supply to adjust the output current of the driving power supply; or silicon-controlled switch can be accessed to the front end of the driving power supply to adjust the output current of the driving power supply. In this way, it is necessary to integrate the external device with control voltage or current on the circuit of lamps, which makes it difficult to produce the lamps and improve the production efficiency. On the other hand, in the dimming process of lamps, users cannot intuitively view the working power of lamps, which brings some difficulties to adjust the power of lamps.

The foregoing content is only used for assisting in understanding the technical scheme of the invention, but not mean the acknowledgement of that the above content is a prior art. A conventional LED lotus lamp is disclosed in CN patent NO. 2017218980605 that its emitting light direction can be adjusted by rotating a plurality of light modules uniformly arranged around a lamp body. However, both the number of the light modules and the range of the adjustable angles can limit the compatibility of such product with different complex lamp housings, and it is also failed to prevent light pollution.

SUMMARY

The main purpose of the present invention is to propose a kind of resistance control device, which is designed to facilitate the users to adjust the luminous power of the lamp.

In order to achieve the above purpose, the resistance control device proposed in the present invention is applied to the lamps. Resistance control device comprises:

Shell, which is provided with an accommodating chamber and the first opening and the second opening connecting the accommodating chamber;

Control module, which includes the resistor and the external plug in the accommodating chamber. The external plug is electrically connected to the resistor. One end of the external plug is set extending the first opening. The external plug is used to connect the resistor to the lamp; and Boosting part, which is connected to the resistor and exposed in the second opening. The boosting part is used to twist or toggle the resistor to adjust the resistance value of the resistor accessing to the lamp.

In one embodiment of the present invention, the control module also includes a circuit board in the accommodating chamber, the resistor is electrically connected to the external plug through the circuit board, and the external plug and the resistor are respectively located on both sides of the circuit board.

In one embodiment of the present invention, the resistor is a knob potentiometer, the knob potentiometer comprises a rotor and the rotor is connected to the external plug;

The boosting part can connect the shell by rotating and connect to the rotor, so that the boosting part can twist the rotor and adjust the resistance value of the resistor accessing to the circuit board.

In one embodiment of the present invention, a plurality of clamping bars are convexly arranged on one side of the boosting part, the boosting part fits to the peripheral limit of the second opening through a plurality of said clamping bars, so that the boosting part can connect to the shell by rotating.

In one embodiment of the present invention, a limit table is provided in one end of the clamping bar away from the boosting part, and the limit table is connected to the inner wall limit of the second opening.

In one embodiment of the present invention, a plurality of avoidance slots around the second opening are provided in the shell;

A boosting bar is provided in one side of the boosting part back to the circuit board, and one end of the boosting bar extends to the edge from the middle of the boosting part;

When the boosting part rotates, one end of the boosting bar can be limited to any of the avoidance slot.

In one embodiment of the present invention, the outer wall of the shell is provided with multiple scales near to multiple avoidance slots.

In one embodiment of the present invention, the boosting bar is provided with an offsetting slot which is set along the length of the boosting bar.

In one embodiment of the present invention, the external plug is headset plug;

Or the external plug is mobile phone charging plug;

Or the external plug is RJ45 plug;

Or the external plug is USB plug.

The embodiment of the present invention also proposes a kind of lamp, including:

The body, which includes the driving power supply circuit and expansion interface that is electrically connected to the driving power supply circuit; and The resistance control device, which is electrically connected to the driving power supply circuit through the matching between the external plug and the expansion interface to adjust the resistance value of the resistor that accesses to the driving power supply circuit, and control the output current and/or voltage of the driving power supply circuit.

In the technical scheme of the present invention, the control module is located in the accommodating chamber of the shell; The control module comprises the external plug located in the accommodating chamber and the resistor which is electrically connected to the external plug; the boosting part is connected to the resistor to toggle or twist the resistor, so that the resistor can access to the lamp with different resistance values; the external plug is used to electrically connect to the lamp. Understandably, the resistor is accessed to the lighting circuit of the lamp through the external plug. When it is necessary to adjust the luminous intensity of lamps, we can toggle or twist the boosting part and adjust the resistance value of the resistor accessing to the lamp, so that different current value or the electric frequency value can be accessed to the lamp's driving power supply and different current values outputted by the driving power supply can be adjusted.

BRIEF DESCRIPTION OF THE DRAWINGS

To better describe the technical schemes of the present invention embodiment or prior art, a brief introduction of drawings to be used in the descriptions of the embodiment or prior art is made hereby. Obviously, the drawings described below are only several embodiments of the present invention. For common technicians in this field, they can obtain other drawings based on these structures shown in the drawings without making additional creative endeavors.

Figure 1:
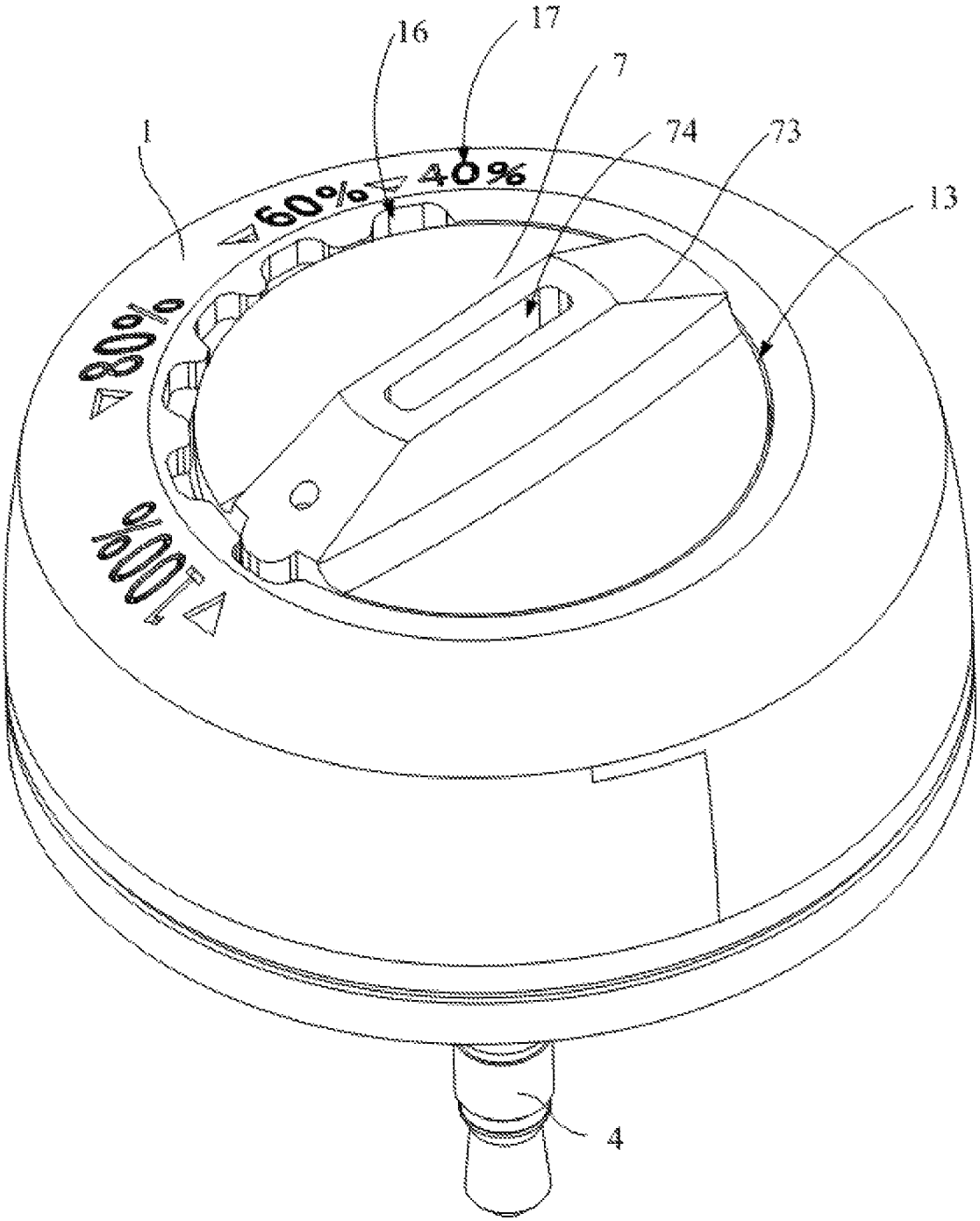
FIG. 1 is the structure diagram of one embodiment of resistance control device in the present invention.

The implementation, functional characteristics and advantages of the present invention will be further illustrated hereinafter in conjunction with the embodiments and accompanying drawings.

DETAILED DESCRIPTION

A clear and complete description of the technical schemes combined with the drawing in the present invention embodiments, the present invention embodiments clearly and completely describe the technical programs. Obviously, only some embodiments of this invention (instead of all the present invention embodiments) are described here. Based on the embodiment of the present invention, all other embodiments acquired by the common technicians in this field without creative work, shall be in the protection scope of the present invention.

It should be noted that, if there is a directional indication (upper, lower, left, right, front, and rear, etc.) in the embodiment of the present invention, the directional indication is only used to explain the relative positional relationship, motion condition, etc. between the components in a particular position (as shown in the drawing), and if the particular attitude is changed, the directional indication is changed accordingly.

In addition, if there are descriptions relating to "first", "second" and the like in embodiments of the present invention, such descriptions of "first", "second" and the like are for descriptive purposes only and are not to be construed as indicating or implying their relative importance or implying an indication of the number of indicated technical features. As such, a feature that defines as "first", "second" may explicitly or implicitly include at least one of that features. In addition, the "and/or" as stated in the whole text should be understood as there are three paralleled schemes where scheme A, or scheme B or scheme A and scheme B can be met at the same time (taking "A and/or B as an example"). In addition, the technical schemes of embodiments may be combined with each other, but must be available for common technicians in this field, and when the combination of the technical scheme is contradictory or impossible, it should be considered that the combination of the technical scheme does not exist and not fall within the scope of the present invention.

The present invention presents a kind of resistance control device. Referring to FIG. 1, it is the structure diagram of one embodiment of resistance control device in the present invention; referring to FIG. 2, it is the section of resistance control device in FIG. 1; referring to FIG. 3, it is the schematic diagram of the assembly structure of resistance control device in FIG. 1; referring to FIG. 4, it is the structure diagram of the first shell in FIG. 3; referring to FIG. 5, it is the structure diagram of an embodiment of the lamp in the present invention.

Figure 2:
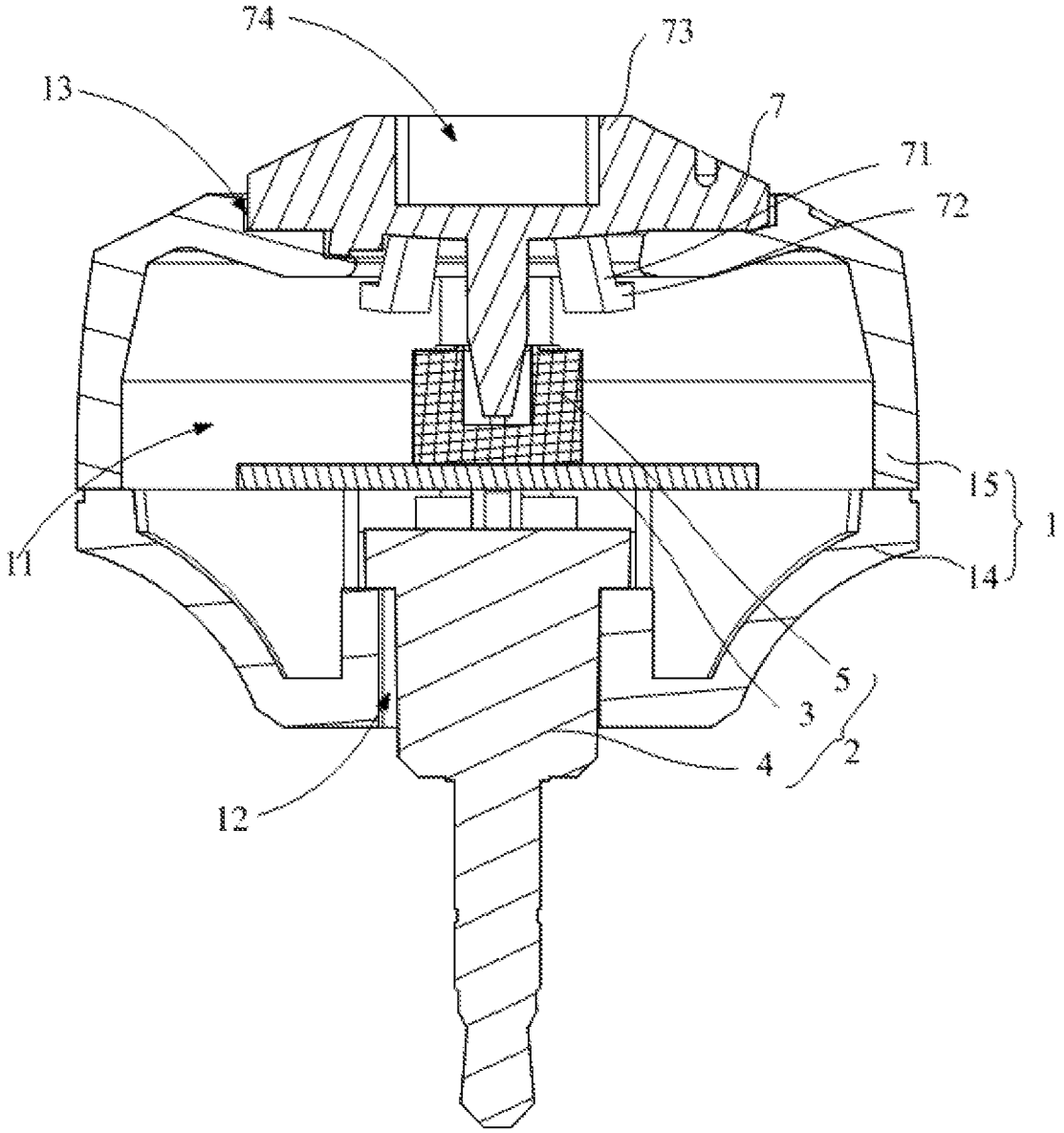
FIG. 2 is the section of resistance control device in FIG. 1.
Figure 3:
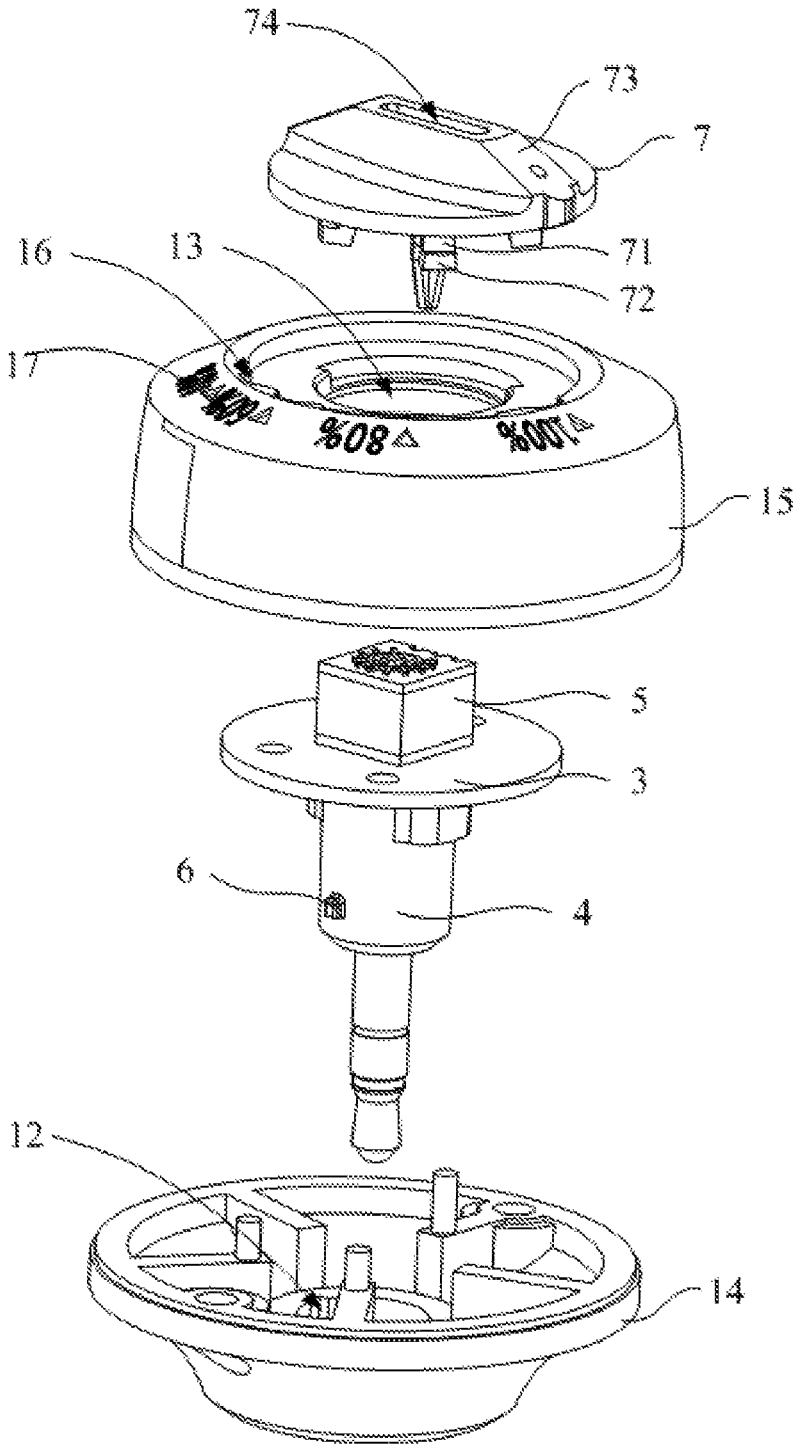
FIG. 3 is the schematic diagram of the assembly structure of resistance control device in FIG. 1.
Figure 5:
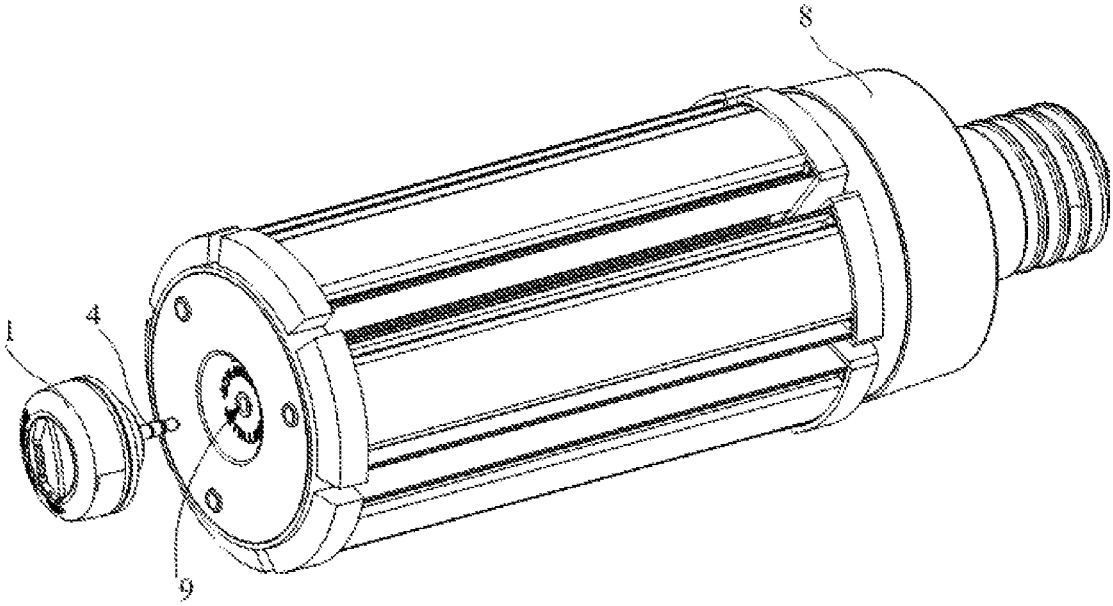
FIG. 5 is the structure diagram of an embodiment of the lamp in the present invention.

In the embodiment of the present invention, as shown in FIGS. 1, 2 and 5, the resistance control device is applied to lamps and the lamp includes the lighting circuit and the driving power supply that connects the lighting circuit; The resistance control device is used for adjusting the resistance value accessing to the driving power supply, and then adjusting the current value or the electric frequency value connected to the lighting circuit. As an electric signal, the current value or the electric frequency value acts on the driving power supply to adjust the current value and/or the voltage value output by the driving power supply of the lamp. In particular, the resistance control device includes:

shell 1 with the accommodating chamber 11, the first opening 12 and the second opening 13 that connect the accommodating chamber 11. Understandably, the shell 1 may be of common plastic materials formed in thermoplastic forming; optionally, as shown in FIG. 3, shell 1 may include the first shell 1 and the second shell 1. The first shell 1 is installed in the second shell, and the first shell 1 and the second shell form the accommodating chamber 11. On the other hand, the first opening 12 is set in the first shell 1 and the second opening 13 is set in the second shell 1.

Optionally, shell 1 may be a stereochemical structure of any shape, such as: a cuboid, a cube, a cylinder, and a three-edge body. Of course, shell 1 may also be an irregular three-dimensional structure.

Optionally, the first opening 12 and the second opening 13 are set on any side of shell 1 and the position of the first opening 12 and the second opening 13 is not limited here.

Control module 2 comprises the resistor 5 in the accommodating chamber 11 and the external plug 4. The external plug 4 is electrically connected to the resistor 5. One end of the external plug 4 is extended to the first opening 12 and the external plug 4 is used to connect the resistor to the lamp. Understandably, resistor 5 is a potentiometer of common specifications, such as: rotary potentiometer, single-coil potentiometer, multi-coil potentiometer and linear sliding potentiometer.

The boosting part 7 is connected to the resistor 5 and exposed in the second opening 13. The boosting part 7 is used to twist or toggle the resistor 5 to adjust the resistance value of the resistor 5 accessing to the lamp. Understandably, resistor 5 comprises the stator seat electrically connected to the driving power supply and the rotor connected to the stator seat. The stator seat is a structure with a certain resistance value, and the rotor rotates or slips on the stator seat so that the stator seat accesses the partial resistance value of the stator seat to the driving power supply. That is to say, the boosting part 7 is directly connected to the rotor of resistor 5. The operator toggles or twists the rotor through boosting part 7, so that the stator seat accesses a partial resistance value to the driving power supply, the specific electric frequency value or current value accesses to the driving power supply and the driving power supply outputs specific voltage or current.

Optionally, the stator seat may also be electrically connected to the lighting circuit to transmit the specific electric frequency value or current value to the driving power supply through the lighting circuit.

Optionally, when the boosting part 7 is toggled or twisted, boosting part 7 may be connected to shell 1 by sliding or rotating to enhance the stability of boosting part 7 when moving or rotating.

In the present embodiment, the control module 2 is set in accommodating chamber 11 of the shell 1; the control module 2 comprises the external plug 4 located in the accommodating chamber 11 and the resistor 5 which is electrically connected to the external plug; the boosting part 7 is connected to the resistor 5 to toggle or twist the resistor 5, so that the resistor 5 can access to the lamp with different resistance values; the external plug 4 is used to electrically connect to the lamp. Understandably, the resistor 5 is accessed to the lighting circuit of the lamp through the external plug 4. When it is necessary to adjust the luminous intensity of lamps, we can toggle or twist the boosting part 7 and adjust the resistance value of the resistor 5 accessing to the lamp, so that different current or current frequency value can be accessed to the lamp's driving power supply and different current values outputted by the driving power supply can be adjusted.

Optionally, the resistance value of resistor 5 may change from 0KΩ to 100KΩ. The smaller the resistance of resistor 5 to the lamp, the smaller the current flowing through the lighting circuit and the driving power supply, and the darker the brightness of the lamp.

In the practical application of the embodiment, the driving power supply of the lamp is a compatible dimming power supply. The dimming power is compatible with 0-10V, PWM (pulse width modulation) and R. Resistance control device is connected to the control chip of the driving power supply. By adjusting the resistance value of resistance control device accessing to the control chip of the driving power supply, the control chip obtains specific electric frequency value or current value to control the specific voltage or current output by the driving power supply.

In one embodiment of the present invention, control module 2 also comprises the circuit board 3 in the accommodating chamber 11. The resistor 5 is electrically connected to the external plug 4 through the circuit board 3 and the external plug 4 and the resistor 5 are respectively located on both sides of circuit board 3. Understandably, the external plug 4 and the resistor 5 are respectively located on both sides of the circuit board 3, and the first opening 12 and the second opening 13 are respectively connected to the accommodating chamber 11. In this way, the first opening 12 and the second opening 13 are on both opposite sides of the shell 1. That is to say, the external plug 4 is exposed on one side of the shell 1 and the boosting part 7 is connected to the resistor 5 passing through the second opening 13 on the other side of the shell 1.

In the present embodiment, the external plug 4 and the resistor 5 are respectively on both sides of the circuit board 3 to avoid the external plug 4 and the resistor 5 are on the same side. While increasing the spacing of the external plug 4 and the resistor 5, the larger circuit board 3 can be avoided and the volume of the resistance control device can be reduced.

Optionally, circuit board 3 is the printing circuit board of common specifications.

Optionally, multiple positioning holes are provided on the circuit board 3 (not identified in the figure). A plurality of positioning pins are arranged in the accommodating chamber 11 (not identified in the figure). The circuit board 3 is positioned in the accommodating chamber 11 through the matching of the positioning hole and the positioning pin.

In one embodiment of the present invention, the resistor 5 is a knob potentiometer, the knob potentiometer comprises a rotor and the rotor is connected to the external plug 4; That is to say, the resistor 5 is a rotary potentiometer, including a stator seat and a rotor that is electrically connected to the stator seat. The stator seat has a certain resistance value. The rotor and the stator seat are respectively connected to the lighting circuit. By rotating the rotor through the boosting part 7, the rotor can access partial resistance of the stator seat to the lighting circuit, and the current value or the electric frequency value can be output to the driving power supply. With the current value or the electric frequency value output by the resistor 5 as the trigger signal, it can control the driving power supply in the output of specific voltage or current.

Optionally, the boosting part 7 can connect to the shell 1 by rotating and connect to the rotor, so that the boosting part 7 can twist the rotor and adjust the resistance value of the resistor 5 accessing to the circuit board 3.

In the present embodiment, the resistor 5 is a structure of knob potentiometer, which can reduce the occupation of resistor 5 and achieve the purpose of small-scale shell 1. By rotating the rotor of the knob potentiometer, partial or whole resistance value of the stator seat can be accessed and connected to the driving power supply, and specific current value or electric frequency value can be transmitted to the driving power supply to control the current or voltage value outputted by the driving power supply, so that the lamp panel works under different power.

In one embodiment of the present invention, a plurality of clamping bars 71 are convexly arranged on one side of the boosting part 7, the boosting part 7 fits to the peripheral limit of the second opening 13 through a plurality of clamping bars 71, so that the boosting part 7 can connect to the shell 1 by rotating.

Optionally, the boosting part 7 is a circular boosting part 7. Multiple clamping bars 71 are radiated centering on the boosting part 7. Understandably, there is an angle between each clamping bar 71 and the side of the boosting part 7. That is to say, the boosting part 7 is matched with the peripheral limit of the second opening 13 through multiple clamping bars 71.

In the present embodiment, the boosting part 7 is connected to the periphery of the second opening 13 through multiple clamping bars 71. The boosting part 7 can connect to the shell 1 by rotating to prevent the boosting part 7 from falling from the resistor 5.

In one embodiment of the present invention, as shown in FIG. 2, a limit table 72 is provided in one end of the clamping bar 71 away from the boosting part 7, and the limit table 72 is connected to the inner wall limit of the second opening 13.

In the present embodiment, the limit table 72 is set on one end of the clamping bar 71 away from the boosting part 7. When the boosting part 7 is set in the shell 1 by rotating, the limit table 72 is connected to the inner wall limit of the periphery of the second opening 13 to improve the stability of the boosting part 7.

In one embodiment of the present invention, as shown in FIG. 1, the shell 1 also has multiple avoidance slots 16 around the second opening 13; a boosting bar 73 is provided on one side of the boosting part 7 back to the circuit board 3, and one end of the boosting bar 73 extends to the edge from the middle of the boosting part 7;

When the boosting part 7 rotates, one end of the boosting bar 73 may be limited to any avoidance slot 16.

In the present embodiment, by setting multiple avoidance slots 16 in the shell 1 and setting the boosting bar 73 on one side of the circuit board 3 back to the boosting part 7, the operator may regard the boosting bar 73 as the stressed structure. That is to say, the force acts on the boosting bar 73 to rotate the boosting part 7; at the same time, one end of the boosting bar 73 extends from the middle of the boosting part 7 to the edge. When the boosting part 7 rotates, one end of the boosting bar 73 may be limited in any avoidance slot 16. When the boosting bar 73 is corresponding to multiple avoidance slots 16, different resistance values of the resistor 5 may be accessed to the lamp.

In one embodiment of the present invention, as shown in FIG. 1, the outer wall of the shell 1 is provided with multiple scales 17 near to multiple avoidance slots 16. In order to obtain the value of the access resistance, scale 17 is set at the corresponding position so that the operator can intuitively obtain the resistance accessing to the lamp.

Multiple scales 17 may be 40%, 60%, 80% and 100%. On the other hand, according to the processing requirements, the corresponding scale 17 may be increased or changed to any value between 10% and 100% (without limitation here).

In one embodiment of the present invention, as shown in FIG. 1, the boosting bar 73 is provided with an offsetting slot 74 which is set along the length of the boosting bar 73.

In the present embodiment, the boosting bar 73 is provided with an offsetting slot 74 which is set along the length of the boosting bar 73 and the operator may twist the boosting part 7 by a tool. Understandably, the tools can be screwdrivers and other tools that can reach into the offsetting slot 74.

In one embodiment of the present invention, the external plug 4 is headset plug. Understandably, headset plug can be headset plug of any specification, such as: pin plug of 2.5 mm or 3.5 mm. Of course, the external plug 4 can also be a serial bus plug.

In one embodiment of the present invention, the external plug 4 is mobile phone charging plug. Understandably, there are three common interfaces of mobile phone charging plug, namely Micro USB interface, USB Type C interface and Lightning interface.

In one embodiment of the present invention, the external plug 4 is RJ45 plug, namely the communication lead connector of common models.

In one embodiment of the present invention, the external plug 4 is USB plug (serial bus plug).

Figure 4:
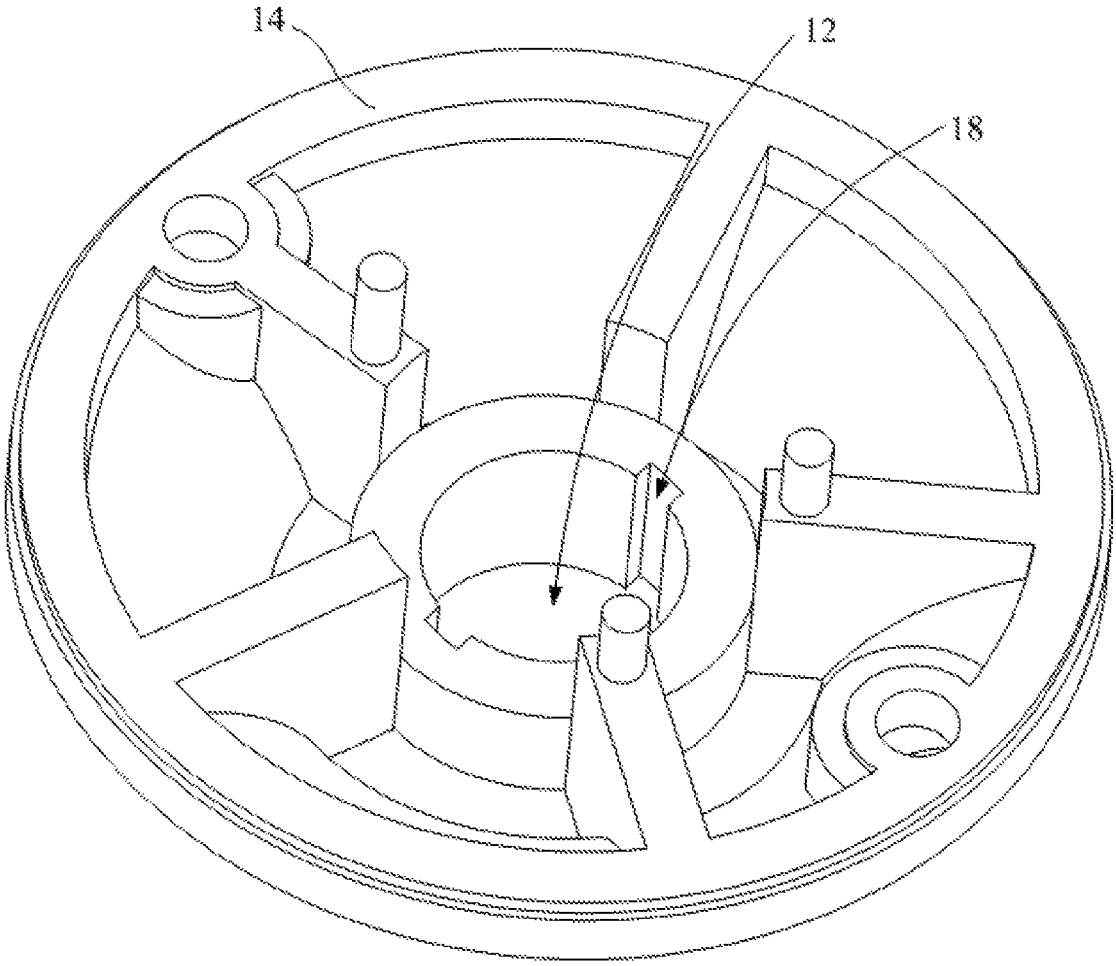
FIG. 4 is the structure diagram of the first shell in FIG. 3.

In one embodiment of the present invention, as shown in FIGS. 3 and 4, the external plug 4 is headset plug with at least one convex rib 6 around. The shell 1 is provided with an alignment groove 18 that connects the first opening 12. The headset plug is set in the first opening 12 and the convex rib 6 is limited in the alignment groove 18 to achieve the rapid alignment to the external plug 4 and the first opening 12. At the same time, it can avoid the rotating accident of the external plug 4 in the first opening 12.

The present invention also puts forward a kind of lamp. As shown in FIG. 5, the lamp includes the body 8 and the resistance control device. The specific structure of the resistance control device refers to the above embodiment. Because the lamp adopts all technical schemes of all above embodiments, at least all the beneficial effects of the technical scheme of the above embodiment are obtained. It will not be repeated in unnecessary details here. Details are as follows:

The body 8 includes the driving power supply circuit and expansion interface 9 that is electrically connected to the driving power supply circuit. Understandably, the driving power supply circuit includes the driving power supply and the lighting circuit that is electrically connected to the driving power supply. The resistance control device is connected to the lighting circuit through the expansion interface 9 and the external plug 4. The incoming current value or electric frequency value of the resistance control device is transmitted to the driving power supply through the lighting circuit so that the driving power supply outputs the corresponding current or voltage. That is to say, the incoming current value or electric frequency value of the resistance control device is only used to generate the electric signal that controls the driving power supply, and the driving power supply adjusts the output current or voltage according to the electric signal.

Understandably, the driving power supply is used to convert the power supply into a specific voltage and current to drive the power converter for lamp light.

Understandably, the lighting circuit connects at least one LED lamp panel. The current or voltage output by the driving power supply is transmitted to at least one LED lamp panel via the lighting circuit, and LED lamp panel emits light.

The resistance control device is electrically connected to the driving power supply circuit through the matching of external plug 4 and expansion interface 9 to adjust the resistance value of resistor 5 accessing to the driving power supply circuit, and control the output current or voltage value of the driving power supply circuit.

The description is only the preferred embodiment of the present invention, and it is not for this reason that the patent scope of the present invention is limited. Any equivalent structural transformation made by using the description of the present invention and the drawing, or direct/indirect application in other related innovation fields under the inventive concept of the present invention, is included in the patent protection scope of the present invention.

What is claimed is:

1. A resistance control device applied to a lamp, comprising:

a shell, which is provided with an accommodating chamber and a first opening and a second opening connecting the accommodating chamber; and a control module, which includes a resistor and an external plug in the accommodating chamber, the external plug is electrically connected to the resistor, one end of the external plug is set extending the first opening, and the external plug is used to connect the resistor to the lamp; and a boosting part, which is connected to the resistor and exposed in the second opening, the boosting part configured to twist or toggle the resistor to adjust a resistance value of the resistor accessing the lamp.

2. The resistance control device as claimed in claim 1, wherein the control module also includes a circuit board in the accommodating chamber, the resistor is electrically connected to the external plug through the circuit board, and the external plug and the resistor are respectively located on opposite sides of the circuit board.

3. The resistance control device as claimed in claim 2, wherein the resistor is a knob potentiometer, the knob potentiometer comprises a rotor and the rotor is connected to the external plug;

the boosting part connects the shell by rotating and connects to the rotor, so that the boosting part can twist the rotor and adjust the resistance value of the resistor accessing the circuit board.

4. The resistance control device as claimed in claim 3, wherein a plurality of clamping bars are convexly arranged on one side of the boosting part, the boosting part fits to a peripheral limit of the second opening through a plurality of said clamping bars, so that the boosting part can connect to the shell by rotating.

5. The resistance control device as claimed in claim 4, wherein a limit table is provided in one end of the clamping bar away from the boosting part, and the limit table is connected to the inner wall limit of the second opening.

6. The resistance control device as claimed in claim 4, wherein an outer wall of the shell is provided with multiple scales near to multiple said avoidance slots.

7. The resistance control device as claimed in claim 1, wherein a plurality of avoidance slots are provided in the shell around the second opening;

a boosting bar is provided in one side of the boosting part back to the circuit board, and one end of the boosting bar extends to an edge from the middle of the boosting part; and when the boosting part rotates, one end of the boosting bar can be limited to any avoidance slot.

8. The resistance control device as claimed in claim 7, wherein the boosting bar is provided with an offsetting slot which is set along a length of the boosting bar.

9. The resistance control device as claimed in claim 1, wherein the external plug is a headset plug;

or the external plug is a mobile phone charging plug;

or the external plug is an RJ45 plug;

or the external plug is a USB plug.

10. A lamp comprising:

a body, which includes a driving power supply circuit and an expansion interface that is electrically connected to the driving power supply circuit;

a resistance control device comprising a shell, which is provided with an accommodating chamber and a first opening and a second opening connecting the accommodating chamber; and a control module, which includes a resistor and an external plug in the accommodating chamber, the external plug is electrically connected to the resistor, one end of the external plug is set extending the first opening, the external plug is used to connect the resistor to the lamp; and a boosting part, which is connected to the resistor and exposed in the second opening, the boosting part configured to twist or toggle the resistor to adjust a resistance value of the resistor accessing the lamp, which is electrically connected to the driving power supply circuit through a matching between the external plug and an expansion interface to adjust the resistance value of the resistor that accesses the driving power supply circuit, and control the output current and/or voltage of the driving power supply circuit.

* * * * *